United States Patent [19]

LeBegue et al.

[11] 4,281,879

[45] Aug. 4, 1981

[54] STABILIZING ASSEMBLY FOR A MINING MACHINE

[75] Inventors: Maurice K. LeBegue, Argillite, Ky.; Ronald W. Keen, Mount Vernon; Donald E. Keller, Nashville, both of Ill.

[73] Assignee: National Mine Service Company, Pittsburgh, Pa.

[21] Appl. No.: 78,072

[22] Filed: Sep. 24, 1979

[51] Int. Cl.[3] ..... E21C 33/00

[52] U.S. Cl. ..... 299/64; 180/8 BA; 198/302; 280/764; 299/76

[58] Field of Search ..... 299/76, 78, 75, 71, 299/72, 31, 57, 18, 64–68; 198/302, 514, 515; 280/764, 765; 180/8 BA; 212/145; 173/23

[56] References Cited

U.S. PATENT DOCUMENTS

| | | | |
|---|---|---|---|
| 3,398,972 | 8/1968 | Ekengard | 280/764 |
| 3,499,684 | 3/1970 | McCracken | 299/64 |
| 3,774,969 | 11/1973 | Lebegue | 299/76 |
| 3,865,197 | 2/1975 | McCormick | 173/23 |
| 3,894,747 | 7/1975 | Wisdom et al. | 280/764 X |
| 3,972,429 | 8/1976 | Sigott et al. | 299/64 X |
| 4,088,371 | 2/1977 | Lebegue et al. | 299/76 |

OTHER PUBLICATIONS

"Stabilizer Shoe Assembly", National Mine Service Co. Parts Catalog 12/22/77.

"Stabilizer Jack", National Mine Service Co. Parts Catalog 12/4/72.

*Primary Examiner*—Ernest R. Purser

*Attorney, Agent, or Firm*—Stanley J. Price, Jr.; John M. Adams

[57] ABSTRACT

A continuous mining machine includes a body portion. A longitudinally extending conveyor support frame is positioned on the body portion. A pair of parallel spaced side walls are positioned outboard of the conveyor support frame. A unitary stabilizing member is pivotally connected at an upper end to the lower edge portions of the side walls and extends transversely between the side walls beyond the width of and below the conveyor support frame. A lower end of the stabilizing member is adapted for movement into and out of engagement with the mine floor. A pair of piston cylinder assemblies for actuating the stabilizing member are connected to and positioned outboard and laterally of the side walls. The piston rods of the assemblies are intermediately connected to the lateral edges of the stabilizing member. A preselected lever arm distance is provided between the pivotal connections of the assemblies and the stabilizing member to the side walls for generating an increased force for pivoting the stabilizing member into contact with the mine floor to stabilize the body portion as the mining machine dislodges material from the mine face and the material is conveyed rearwardly on the body portion.

6 Claims, 5 Drawing Figures

STABILIZING ASSEMBLY FOR A MINING MACHINE

BACKGROUND OF THE INVENTION

1. Field of the Invention

This invention relates to a stabilizing assembly for a mining machine and more particularly for a stabilizing assembly mounted on the mining machine body portion in a manner to extend substantially the width of the conveyor support frame on the body portion to effectively anchor the rearward portion of the mining machine and thereby reduce the rocking motion of the mining machine during the mining operation.

2. Description of the Prior Art

Continuous mining machines, as illustrated in U.S. Pat. No. 3,774,969, are utilized in underground mining operations to continuously dislodge solid material from the face of a mine shaft. A boom member extends forwardly from an elongated body portion of the mining machine that is propelled through the mine on endless crawler tracks. The boom member is pivotally connected to the mining machine body portion and rotatably supports a cutter drum having peripherally extending elements. The cutter drum extends transversely to the longitudinal axis of the body portion, and upon rotation the cutting elements dislodge solid material from the mine face.

The dislodged material is moved rearwardly of the cutter drum by a gathering device onto the receiving end of a conveyor mechanism that extends longitudinally on the body portion of the mining machine. The conveyor mechanism includes a discharge end portion that is supported by the conveyor support frame for horizontal pivotal movement rearwardly of the mining machine. A main conveyor portion is pivotally connected to the conveyor support frame for vertical pivotal movement. The main conveyor portion is connected to the discharge end portion by suitable linkage mechanism to permit horizontal pivoting of the discharge end portion relative to the main conveyor portion. The discharge end portion is also vertically movable with the main conveyor portion.

With this arrangement the conveyor discharge end portion is operable to be maintained in material receiving relation with a material haulage vehicle or another conveyor as the mining machine maneuvers the cutter drum to dislodge the material from the mine face. By maintaining the discharge end portion in material receiving relation with the haulage vehicle, a continuous mining operation is carried out by the conveyance of the loose material from the mine face as the solid material is dislodged from the mine face. Thus during the mining operation the conveyor mechanism is being moved both vertically and horizontally and the cutter drum is moved by the boom member to perform upward and downward shear cuts in the mine face. Consequently, considerable forces are imparted to the mining machine body portion tending to displace or rock the body portion from its selected position for performing the shear cut in the mine face.

In order to stabilize the mining machine body portion as the boom member is raised and lowered to maneuver the cutter drum and dislodged material is being conveyed rearwardly on the body portion by the conveyor mechanism, it is known to rigidify or stabilize the body portion by anchoring the body portion on the mine floor. Anchoring the mining machine body portion is accomplished in one manner by pivoting a stabilizing arm member into engagement with the mine floor. The arm member is moved downwardly with sufficient force generally under the action of piston cylinder assemblies to sufficiently embed the arm member into the mine floor and thus provide an anchor for the mining machine body portion on the mine floor. U.S. Pat. No. 4,088,371 illustrates this general arrangement.

It is also known to use stabilizing devices with other types of machines that are operable in an underground mine. U.S. Pat. No. 3,865,197 discloses a mine roof drilling machine which is carried on a mobile body portion. During the drilling operation the mobile body portion is stabilized by an arm member which is pivotally connected to the frame of the body portion to move downwardly into engagement with the mine floor to rigidify the body portion and maintain it immovable during the drilling operations.

With the conventionally known stabilizing assemblies for continuous mining machine, the stabilizing assemblies are positioned beneath the conveyor support frame at the rearward end portion of the body portion. The piston cylinders for actuating the stabilizing assembly are also positioned beneath the conveyor support frame. One end of the piston cylinders is connected to the conveyor support frame and the opposite end or the extensible piston rod is connected to the stabilizing assembly. One end of the stabilizing assembly is, in turn, connected to the lower surface of the conveyor support frame.

One disadvantage with the known arrangement for connecting the piston cylinders to the stabilizing assembly is the positioning of the piston cylinders beneath the conveyor support frame and inboard of the lateral edges of the stabilizing assembly. Consequently, the stabilizing assembly must be constructed to permit the stabilizing assembly to pivot past the piston cylinders. As a result the pivotal connection of the piston cylinders to the conveyor support frame and the pivotal connection of the stabilizing assembly to the conveyor support frame are very close together. This provides for a reduced lever arm distance between the respective pivotal connections. Consequently, the force generated by the piston cylinders to both raise and lower the stabilizing assemblies is limited.

Therefore, there is need in a continuous mining machine for a stabilizing assembly that is pivotally connected to the body portion of the mining machine and actuated by piston cylinders in an arrangement to provide a maximum bearing surface in contact with the mine floor to securely anchor the mining machine and to generate the required force to efficiently move the stabilizing assembly into and out of its operative position.

SUMMARY OF THE INVENTION

In accordance with the present invention there is provided a stabilizing assembly for a mining machine that includes a mining machine body portion mounted on means for propelling the body portion. The mining machine body portion includes a pair of longitudinally extending side walls. The side walls are spaced apart substantially the width of the mining machine body portion. The side walls each have vertically extending inner and outer surfaces. Stabilizing means is pivotally connected to the side walls is operable to move into engagement with the mine floor to maintain the mining machine body portion in a stabilized position. Stabilizing means extends transversely between the side walls substantially the width of the mining machine body portion. An actuator means is provided for moving the stabilizing means into and out of engagement with the mine floor. The actuator means is pivotally connected at one end to the side walls in a lateral position oppositely of the outer surfaces of the side walls. The actuator means is connected at a second end portion to the stabilizing means such that the distance between the pivotal connections of the actuator means and the stabilizing means to the side walls provides for an increased force to be exerted on the stabilizing means to maintain the stabilizing means in contact with the mine floor.

Each of the side walls of the mining machine body portion include an upper edge portion and a lower edge portion. The stabilizing means are arranged to extend between the side walls and are pivotally connected to the inner surfaces of the side walls adjacent to the lower edge portions thereof. The actuator means which include a pair of piston cylinder assemblies are positioned outboard of the side walls oppositely of the outer surfaces thereof. Each of the piston cylinder assemblies includes a cylinder portion that is pivotally connected to the side walls adjacent to the upper edge portions thereof. Extensible piston rod of each piston assembly is connected to the stabilizing means at a point intermediate the ends of the stabilizing means at the lateral edge portion thereof. With this arrangement the length of the lever arm between the connection of the piston rod of the piston cylinder assembly and the pivotal connection of the stabilizing means to the side walls permits the application of increased torque about the pivot point of the stabilizing means for exerting a downward force upon the stabilizing means to securely anchor it in contact with the mine floor and to lift the stabilizing means out of contact with the mine floor.

A conveyor support frame extends longitudinally on the mining machine body portion. The conveyor support frame is positioned between and in parallel relation with the side walls. The stabilizing means are positioned in underlying relation with the conveyor support frame to extend beyond the width of the conveyor support frame, thereby more effectively stabilize the conveyor support frame when the stabilizing means is positioned on the mine floor.

The piston cylinder assemblies of the actuator means are connected to the side walls in a position laterally spaced from the conveyor support frame. With this arrangement the operating angle of the piston cylinder assemblies throughout the operating range thereof is substantially improved and permits the application of increased torque about the pivot point of the stabilizing means beneath the conveyor support frame.

Preferably the stabilizing means includes a unitary body portion having a transverse dimension extending between the side walls which dimension is greater than the width of the conveyor support frame. In this manner the unitary body portion is operable to more effectively support the conveyor support frame. Also by positioning the piston cylinder assemblies laterally of the stabilizing means, the piston cylinder assemblies are not located within the range of the pivotal movement of the stabilizing means. Consequently, the stabilizing means can be constructed of a unitary body portion which includes lateral edge portions positioned closely adjacent and parallel to the side walls for movement relative thereto. Extending between the lateral edge portions is a ground engaging end portion that extends beyond the width of the conveyor support frame and is operable to move in to and out of engagement with the mine floor. The stabilizing means body portion also includes reinforcing members extending across the body portion to provide a rigid structure for securely anchoring the mining machine body portion when the ground engaging end portion is embedded into the mine floor upon actuation of the piston cylinder assemblies.

Accordingly the principal object of the present invention is to provide for a mining machine, a stabilizing assembly that is pivotally connected to the mining machine body portion and operable to anchor the rearward portion of the mining machine to prevent shifting of the mining machine as the mining machine dislodges solid material from the mine face and the material is conveyed rearwardly on the mining machine.

Another object of the present invention is to provide a mining machine stabilizing assembly that is pivotally connected to the machine body portion and arranged to extend transversely beneath the conveyor support frame the entire width thereof and thereby anchor the body portion and prevent swaying or rocking motion of the conveyor support frame when lowered into contact with the mine floor.

These and other objects of the present invention will be more completely disclosed and described in the following specification, the accompanying drawings, and the appended claims.

DESCRIPTION OF THE PREFERRED EMBODIMENT

Figure 1:
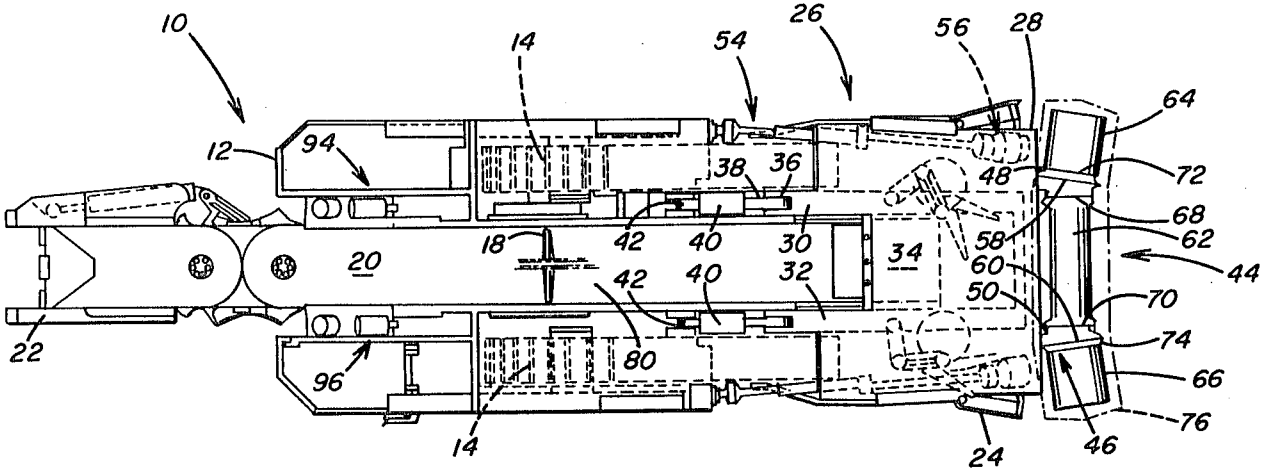
FIG. 1 is a top plan view of the continuous mining machine of the present invention, illustrating the cutter drum member with the canted end portions.
Figure 2:
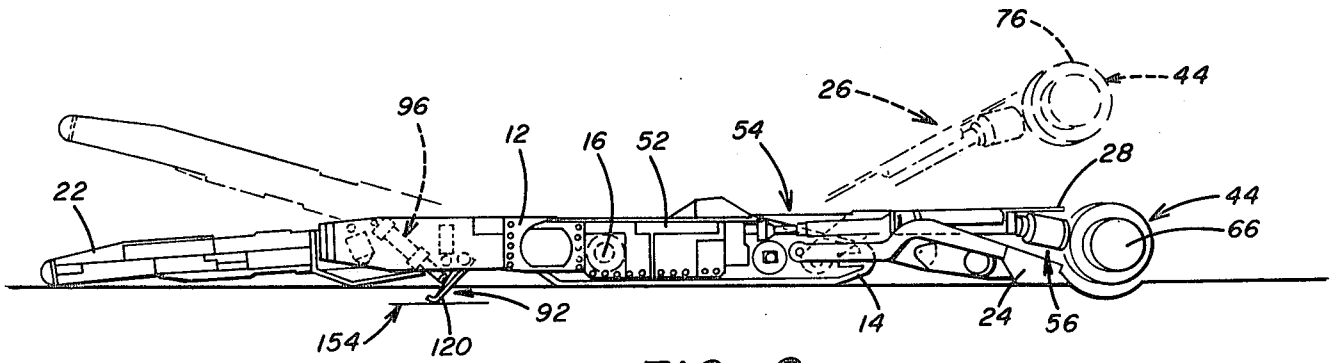
FIG. 2 is a view in side elevation of the continuous mining machine shown in FIG. 1, illustrating the stabilizing assembly pivoted downward into contact with the mine floor.

Referring to the drawings and particularly to FIGS. 1 and 2 there is illustrated a continuous mining machine generally designated by the numeral 10 that has a body or frame portion 12 suitably mounted on endless crawler tracks 14. Hydraulic motors 16 are provided to propel the mining machine 10 on the endless crawler tracks 14 to advance the mining machine during the mining operation. An endless conveyor mechanism 18 is positioned in a longitudinal trough member 20 and conveys dislodged material therein from the front of the mining machine to an articulated rear discharge section 22. As illustrated in FIG. 2, a gathering device 24 extends forwardly from the body portion 12 and is arranged to gather and feed the dislodged material onto the conveyor trough 20 so that the dislodged material can be conveyed rearwardly by the endless conveyor mechanism 18 to the discharge section 22.

As illustrated in FIGS. 1 and 2, a boom member generally designated by the numeral 26 extends forwardly from the body portion 12. A cover plate 28 extends from the receiving end portion of the conveyor mechanism 18 forwardly therefrom into overlying relation with the front edge of the gathering device 24. The boom member 26 includes a pair of parallel rearwardly extending arm members 30 and 32 that are connected at their forward end portions to a boom housing 34 that extends transversely across the front of the mining machine 10 beneath the cover plate 22.

Each of the arm members 30 and 32 are pivotally connected at a pivot point 36 to a piston rod 38 of a piston cylinder assembly 40. The pair of piston cylinder assemblies 38 illustrated in FIG. 1 are, in turn, pivotally connected to the mining machine body portion 12 at pivot points 42. With this arrangement the boom arm members 30 and 32 are pivotally connected to the mining machine body portion 12.

Upon extension and retraction of the piston rods 38 and within the piston cylinder assemblies 40, the boom member 26 is operable to pivot about the pivot points 36 of the arm members 30 and 32 to move the boom member 26 vertically to the position illustrated in phantom in FIG. 2. A cutter drum assembly generally designated by the numeral 44 connected to the boom member 26 performs an upward shear cut of the mine face. Also the mining machine 12 is operable to advance into the mine face with the boom member 26 in the upper position, as illustrated in phantom in FIG. 2. The piston cylinder assemblies 40 operable to pivot the boom member 26 downwardly to the position as illustrated by the solid lines in FIG. 2. In this manner the cutter drum assembly 44 dislodges material from the mine face by a downward shear cut.

The boom member 26 extends forwardly from the boom housing 32. The cutter drum assembly 44 is supported by a drum housing generally designated by the numeral 46. The drum housing 46 includes a pair of rearwardly extending arm members 48 and 50 that are suitably connected to the boom housing 34.

A pair of cutter drum motors 64, one of which is illustrated in FIG. 2, are mounted on the body portion 12 and are operable to rotate the cutter drum assembly 44. A drive shaft assembly generally designated by the numeral 54 is drivingly connected to each of the motors 52 and extends forwardly therefrom to a clutch mechanism generally designated by the numeral 56. The clutch mechanisms 56 are mounted on the drum housing 46. The clutch mechanisms 56 connect the motors 64 to the drive gearing for the cutter drum assembly 44.

The drum housing 46 includes nonrotatably angular housing portions 58 and 60 that extend forwardly from the drum housing arm members 48 and 50. The rotatable portions of the cutter drum assembly 44 are mounted on the nonrotatable annular housing portions 58 and 60. The drive means for the cutter drum assembly 44 extend through the annular housing portions 58 and 60 and are connected to gearing within the cutter drum assembly 44 to rotate the cutter drum assembly 44 to dislodge material from the mine face.

The cutter drum assembly 44 has an intermediate drum section 62 and a pair of end drum sections 64 and 66. The intermediate drum section 62 is rotatably supported by the annular housing portions 58 and 60. The end drum section 64 is canted with respect to the intermediate drum section 62 and is rotatably supported by the annular housing portion 58. Likewise the end drum section 66 is canted with respect to the intermediate drum section 62 and is rotatably supported by the annular housing portion 60.

The intermediate drum section 62 has outer annular edge portions 68 and 70, and the end drum sections 64 and 66 have inner annular edge portions 72 and 74. The intermediate drum section 62 and the end drum sections 64 and 66 include a plurality of cutting elements that extend peripherally from the respective drum sections. The end drum sections 64 and 66 are positioned so that the bit pattern formed by the row of cutting elements along the inner annular edge portions 72 and 74 overlap the bit pattern of the row of cutter elements along the intermediate drum section outer annular edge portions 68 and 70 along the front of the cutter drum assembly 44. The bit pattern of the respective drum sections divert rearwardly and outwardly along the rear of the cutter drum assembly 44 so at this point the cutting elements of the intermediate drum section 62 are spaced from the cutting elements of the end drum section 64 and 66.

This arrangement is illustrated in FIG. 1 where the individual cutting elements have been eliminated from the respective drum sections for purposes of illustration. The bit pattern formed by the cutting elements is indicated by the —o line 76. Thus with the above arrangement the cutter drum assembly 44 is operable to dislodge a continuous kerf of material from the mine face without leaving unmined portions in the face. As the cutter drum assembly 44 completes a shear cut in the mine face a relatively horizontal roof and floor are formed in the mine passageway.

Figure 3:
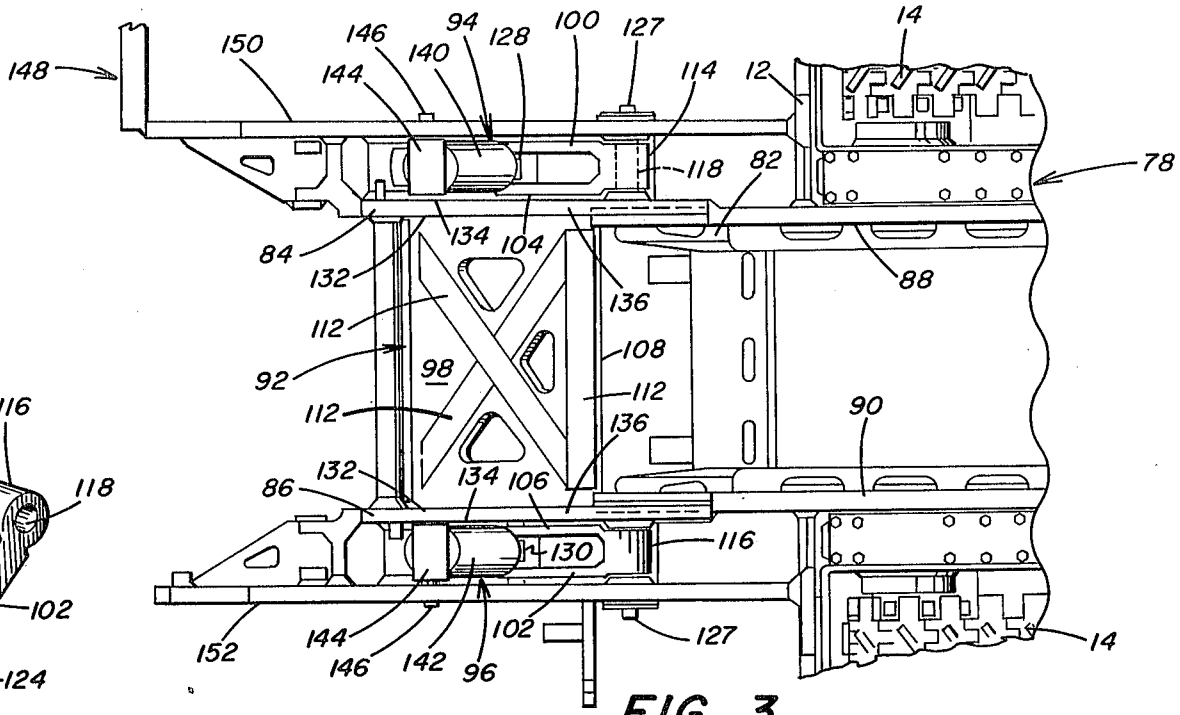
FIG. 3 is an enlarged fragmentary plan view of the rearward end portion of the mining machine, illustrating the connection of the stabilizing assembly to the mining machine body portion.
Figure 4:
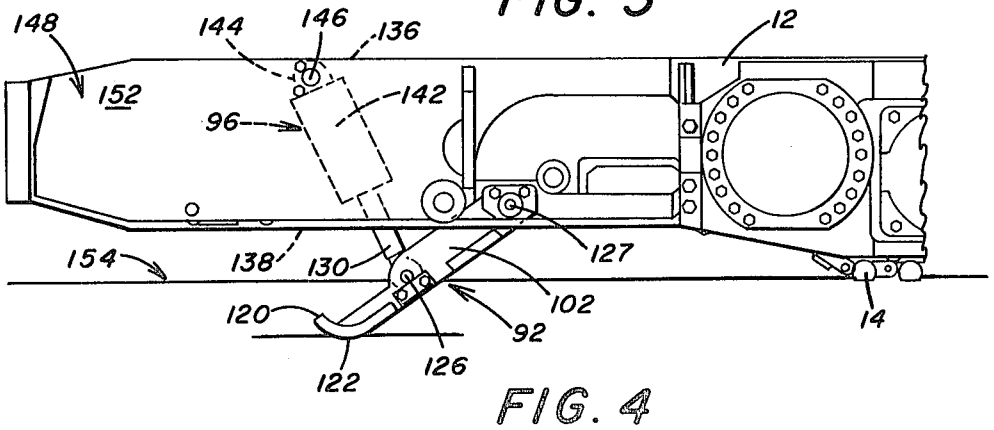
FIG. 4 is a view in side elevation of the rearward end portion of the mining machine shown in FIG. 3, illustrating the stabilizing assembly in a lowered position abutting the mine floor for stabilizing the mining machine body portion.

The conveyor mechanism 18 is positioned on a conveyor support frame generally designated by the numeral 78 that extends longitudinally on the body portion 12, as illustrated in FIG. 3. The conveyor support frame 78 extends the length of the mining machine body portion 12 at the conveyor mechanism 18 includes the articulated rear discharge section 22 described above and a main conveyor section 80 that extends from the gathering device 24 at the forward end of the body portion 12 to its connection to the rear discharge section 22. Thus the conveyor support frame 78 includes a discharge end portion 82, as illustrated in FIGS. 3 and 4. The conveyor support frame discharge end portion 82 supports the conveyor rear discharge section 22; however, for the purposes of clarity of illustration the conveyor mechanism 18 and particularly the rear discharge section 22 thereof has been deleted from FIGS. 3 and 4. As illustrated in FIG. 2, the conveyor rear discharge section 22 is supported by the conveyor support frame discharge end portion 82 for pivotal movement through a vertical arc.

As illustrated in FIG. 3 the mining machine body portion includes a pair of longitudinally extending side walls 84 and 86. The pair of side walls 84 and 86 are positioned in parallel relation and are spaced apart substantially the width of the mining machine. The conveyor support frame 78 also includes a pair of parallel spaced side walls 88 and 90 that are positioned within the side walls 84 and 86 and are suitably connected thereto to extend forwardly from the side walls 84 and 86 on the machine body portion 12. Pivotally connected to the side walls 84 and 86 and extending transversely beyond the side walls 88 and 90 adjacent to the conveyor support frame discharge end portion 82 is a stabilizing assembly generally designated by the numeral 92. The stabilizing assembly 92 is actuated by a pair of piston cylinder assemblies 94 and 96 to move from a raised position on the body portion 12 to a lowered position, as illustrated in FIGS. 2 and 4, in contact with the mine floor and thereby anchor the rearward end portion of the mining machine body portion 12 as the cutter drum 42 is operated to dislodge solid material from the mine face and the loose material is conveyed rearwardly on the conveyor mechanism 18. The stabilizing assembly 92 includes a unitary body portion 98 having a transverse demension that extends between the side walls 84 and 86.

Figure 5:
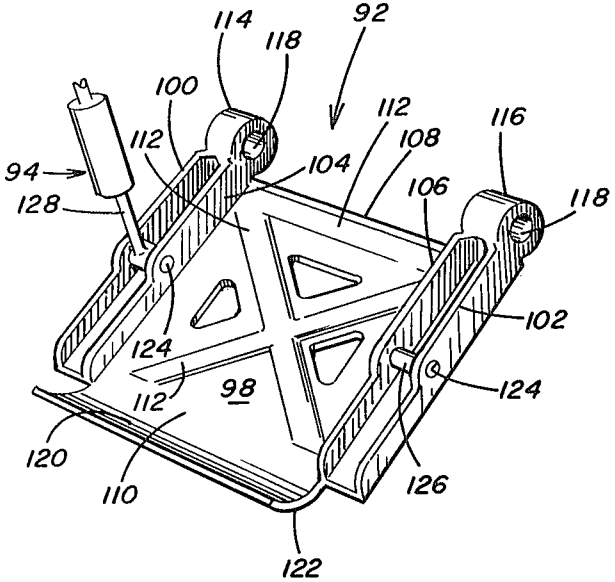
FIG. 5 is a fragmentary isometric view of the stabilizing assembly, illustrating the manner in which the apparatus for raising and lowering the stabilizing assembly is connected thereto.

The unitary body portion 98 of the stabilizing assembly 92 also includes a pair of channel shaped arm members 100 and 102, as illustrated in FIG. 5, forming longitudinally extending lateral edges 104 and 106 respectively. The lateral edge portions 104 and 106 are positioned closely adjacent and parallel to the side walls 84 and 86 for movement relative thereto. The stabilizing member body portion 98 also includes a transversely extending first end portion 108 and an opposite or second transversely extending end portion 110. Provided on the body portion 98 between the first and second end portions 108 and 110 are a plurality of reinforcing members 112 that serve to rigidify and strengthen the unitary body portion 98. Formed integral with the channel shaped arm members 100 and 102 adjacent the first end portion 108 are a pair of bosses 114 and 116, each being provided with a bore 118 extending longitudinally through each boss. As will be explained later in greater detail the bosses 114 and 166 are adapted for pivotal connection to the machine body portion side walls 84 and 86. Extending outwardly from the stabilizing assembly second end portion 110 is a ground engaging portion 120 having an arcuate surface 122 that also extends transversely the length of the body portion 98 the entire width of the conveyor support frame 78. The arcuate surface 122 is operable to provide an enlarged bearing surface to be moved into contact with the mine floor and stabilize the mining machine body portion 12. Positioned intermediate the body portion end portions 108 and 110 and extending transversely through the channel shaped arm members 100 and 102 are bores 124. The bores are arranged to receive pivot pins 126 that extend therethrough and through bores provided in the end portions of piston rods 128 and 130 associated with the piston cylinder assemblies 94 and 96.

Each of the mining machine body portion side walls 84 and 86 includes vertically extending inner surface 132 and a vertically extending outer surface 134. Also each of the side walls 84 and 86 includes an upper horizontal edge portion 136 and a lower horizontal edge portion 138. Piston cylinders 140 and 142 of the piston cylinder assemblies 94 and 96 respectively are positioned laterally of the side walls 84 and 86 in a position opposite the side wall outer surfaces 134. Each of the piston cylinders 140 and 142 includes a pivotal end portion 144 that is pivotally connected by a pivot pin 146 to the respective side walls 84 and 86 adjacent to the side wall upper edge portions 136 as illustrated in FIG. 4. The stabilizing assembly body portion 98 is, in turn, pivotally connected to the machine body portion side walls 84 and 86 at a location adjacent to the side wall lower edge portions 138. With this arrangement the pivot points for the piston cylinder assemblies 94 and 96 and for the stabilizing assembly body portion 98 on the side walls 84 and 86 are positioned in substantial spaced relation which as will be explained later in greater detail provides a lever arm for the stabilizing assembly 92 of increased length so as to permit the application of increased force on the stabilizing assembly 92 for movement into and out of position engaging the mine floor.

As illustrated in FIG. 3 the mining machine body portion 12 includes an outer housing generally designated by the numeral 148 which includes a pair of parallel spaced walls 150 and 152. The walls 150 and 152 are positioned outboard of the side walls 84 and 86. The piston cylinder assemblies 94 and 96 are positioned in the longitudinal opening provided between the pairs of spaced apart walls 84, 150, 86, and 152. The pivot pins 146 for the piston cylinders 140 and 142 also extend through the housing walls 150 and 152. Similarly, the pivot pins 127 for the pivotal end portion of the stabilizing assembly 92 extends through the housing walls 150 and 152. Thus with this arrangement the stabilizing assembly 92 is arranged for pivotal movement on the mining machine body portion 12 beneath the conveyor support frame 78. As illustrated in FIG. 4, the piston cylinder assemblies 94 and 96 are in their actuated position with the piston rods 128 and 130 extended so that the stabilizing assembly 92 is lowered. The combination of the force exerted by the piston cylinder assemblies 94 and 96 and the weight of the mining machine body portion 12 on the stabilizing assembly 92 urges the ground engaging portion 120 into contact with the mine floor so as to embed the ground engaging portion 120 beneath the surface of the mine floor, as generally designated by the numeral 154 in FIGS. 2 and 4. With this arrangement the stabilizing assembly 92 securely anchors the mining machine body portion 12 to keep the swaying or rocking motion of the machine to a minimum during the material dislodging and conveying operations.

Further as illustrated in FIG. 4, by pivotally connecting the piston cylinder assemblies 94 and 96 adjacent the side wall upper edges 136 and by pivotally connecting the stabilizing assembly 92 adjacent the side wall lower edge portions 138, the piston cylinder cylinder assemblies 94 and 96 are operable to apply an increased torque upon the stabilizing assembly 92. This results from increasing the distance of the lever arm that extends between the pivotal connection of the piston rods 128 and 130 to the stabilizing assembly 92 and the pivotal connection of the stabilizing assembly 92 to the side walls 84 and 86. Thus by providing the lever arm of increased length for the piston cylinder assemblies capable of exerting a preselected force, the torque applied to the pivotal stabilizing assembly 92 can be substantially increased. This permits the lifting force available for lifting the stabilizing assembly 92 when embedded in the mine floor to be increased. Consequently, piston cylinder assemblies of lesser capacity can be utilized to generate the same lifting force of larger capacity piston cylinder assemblies.

According to the provisions of the Patent Statutes, we have explained the principle, preferred construction and mode of operation of our invention and have illustrated and described what we now consider to represent its best embodiments. However, it should be understood, within the scope of the appended claims, the invention may be practiced otherwise than as specifically illustrated and described.

We claim:

1. A stabilizing assembly for a mining machine comprising, a mining machine body portion mounted on means for propelling said body portion, said mining machine body portion including a pair of longitudinally extending side walls, said side walls being spaced apart substantially the width of said mining machine body portion, said side walls each having vertically extending inner and outer surfaces, stabilizing means pivotally connected to said side walls for moving into engagement with the mine floor to maintain said mining machine body portion in a stabilized position, a conveyor support frame extending longitudinally on said mining machine body portion between said side walls, said stabilizing means being positioned in underlying relation with said conveyor support frame, said stabilizing means including a unitary body portion having a transverse dimension extending between said side walls and beyond the width of said conveyor support frame, said unitary body portion having lateral edge portions, a first end portion pivotally connected to said side walls, and a second end portion movable into and out of contact with the mine floor, said unitary body portion including reinforcing members extending across said body portion and substantially the width of said mining machine body portion to rigidify said unitary body portion, actuator means for moving said stabilizing means into and out of engagement with the mine floor, said actuator means being pivotally connected at one end to said side walls in a position laterally spaced from said conveyor support frame, said actuator means being connected to the lateral edge portions of said unitary body portion such that the distance between the pivotal connections of said actuator means and said unitary body portion to said side walls provides for an increased force to be exerted on said unitary body portion to maintain said unitary body portion in contact with the mine floor.

2. A stabilizing assembly for a mining machine as set forth in claim 1 which includes, said side walls each having an upper edge portion and a lower edge portion, said stabilizing means extending between said side walls and being pivotally connected to said side walls adjacent to said lower edge portions thereof, and said actuator means being positioned outboard of said side walls oppositely of said outer surfaces thereof and pivotally connected at said one end portion adjacent to said upper edge portions of said side walls.

3. A stabilizing assembly for a mining machine as set forth in claim 1 in which, said ground engaging portion has an arcuate surface adapted to contact the mine floor and provide an increased bearing surface for supporting said stabilizing means on the mine floor.

4. A stabilizing assembly for a mining machine as set forth in claim 1 in which, said unitary body portion lateral edge portions being positioned closely adjacent and parallel to said side walls for movement relative thereto.

5. A stabilizing assembly for a mining machine as set forth in claim 1 which includes, said actuator means being pivotally connected at said one end to said side walls whereby said side walls and said unitary body portion lateral edge portions are positioned between said actuator means, and said actuator means being connected at another end to said unitary body portion lateral edge portions intermediate said first and second end portions.

6. A stabilizing assembly for a mining machine as set forth in claim 1 in which, said actuator means includes a pair of piston cylinder assemblies, said piston cylinder assemblies each including a cylinder portion pivotally connected outboard to said respective side wall and an extensible piston rod portion, said piston rod portion being connected to said lateral edge portions of said unitary body portion, and said cylinder portion being pivotally connected to said respective side wall to provide a preselected lever arm distance between said pivotal connection of said cylinder portion and said pivotal connection of said unitary body portion to said side wall for generating an increased force for pivoting said stabilizing means into and out of engagement with the mine floor.

* * * * *